US008706463B2

(12) United States Patent
Dykstra et al.

(10) Patent No.: US 8,706,463 B2
(45) Date of Patent: Apr. 22, 2014

(54) SYSTEM AND METHOD FOR COMPLETION OPTIMIZATION

(75) Inventors: Jason D. Dykstra, Carrollton, TX (US); Kenneth L. Schwendemann, Flower Mound, TX (US); Orlando DeJesus, Frisco, TX (US); Michael L. Fripp, Carrollton, TX (US); Syed Hamid, Dallas, TX (US); Tommy F. Grigsby, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 422 days.

(21) Appl. No.: 13/141,058

(22) PCT Filed: Nov. 30, 2009

(86) PCT No.: PCT/US2009/066043

§ 371 (c)(1),
(2), (4) Date: Sep. 10, 2011

(87) PCT Pub. No.: WO2010/082975

PCT Pub. Date: Jul. 22, 2010

(65) Prior Publication Data

US 2012/0179428 A1 Jul. 12, 2012

Related U.S. Application Data

(60) Provisional application No. 61/145,183, filed on Jan. 16, 2009.

(51) Int. Cl.

| | |
|---|---|
| ***G06G 7/48*** | (2006.01) |
| ***E21B 47/00*** | (2012.01) |
| ***E21B 47/09*** | (2012.01) |

(52) U.S. Cl.

USPC ..... 703/10; 166/254.11; 166/255.1

(58) Field of Classification Search

USPC ..... 703/9, 10; 166/250.13, 254.1, 255.1; 702/2, 9, 36, 150

See application file for complete search history.

(56) References Cited

U.S. PATENT DOCUMENTS

| | | | |
|---|---|---|---|
| 4,417,620 | A | 11/1983 | Shafir |
| 5,206,836 | A | 4/1993 | Holzhausen et al. |
| 6,343,656 | B1 | 2/2002 | Vazquez et al. |
| 6,795,773 | B2 | 9/2004 | Soliman et al. |
| 6,820,702 | B2 | 11/2004 | Niedermayr et al. |

(Continued)

OTHER PUBLICATIONS

International Search Report and Written Opinion (PCT/US2009/066043), EPO (Feb. 2, 2010).

(Continued)

*Primary Examiner* — David Silver
*Assistant Examiner* — Andre Pierre Louis
(74) *Attorney, Agent, or Firm* — Lawrence R. Youst

(57) ABSTRACT

A system for completing a wellbore (38) having multiple zones. The system includes a completion (42) having a plurality of landing points defined therein positioned within the wellbore (38). A service tool is axially movable within the completion (42). The service tool is coupled to a pipe string (36) extending from the surface and selectively supported by a movable block (30) above the surface. A subsurface model is defined in a computer operably associated with the wellbore (38). The model is operable to predict the position of the service tool relative to the landing points of the completion (42) based upon a dynamic lumped mass model of the service tool and a dynamic lumped capacitance thermal model of the wellbore environment.

23 Claims, 5 Drawing Sheets

(56) References Cited

U.S. PATENT DOCUMENTS

| | | | | |
|---|---|---|---|---|
| 6,957,575 | B2 | 10/2005 | Boucher et al. | |
| 7,013,249 | B1 | 3/2006 | Davis | |
| 7,114,578 | B2 | 10/2006 | Hutchinson | |
| 7,172,037 | B2 | 2/2007 | Dashevskiy et al. | |
| 7,188,058 | B2 | 3/2007 | Hardy et al. | |
| 7,194,913 | B2 | 3/2007 | Morrison et al. | |
| 7,251,590 | B2 | 7/2007 | Huang et al. | |
| 7,313,480 | B2 | 12/2007 | Chen et al. | |
| 7,363,967 | B2 | 4/2008 | Burris, II et al. | |
| 2002/0139527 | A1 | 10/2002 | Song et al. | |
| 2004/0256152 | A1* | 12/2004 | Dashevskiy et al. | 175/25 |
| 2005/0071120 | A1* | 3/2005 | Hutchinson | 702/150 |
| 2005/0194183 | A1 | 9/2005 | Gleitman et al. | |
| 2005/0241824 | A1 | 11/2005 | Burris, II et al. | |
| 2005/0241825 | A1 | 11/2005 | Burris, II et al. | |
| 2006/0041411 | A1 | 2/2006 | Yong et al. | |
| 2007/0055536 | A1 | 3/2007 | Caveny et al. | |
| 2007/0113640 | A1 | 5/2007 | De Jesus et al. | |
| 2007/0185696 | A1 | 8/2007 | Moran et al. | |
| 2009/0283323 | A1 | 11/2009 | Quernheim et al. | |

OTHER PUBLICATIONS

European Examination Report (09 764 152.6), EPO (Jun. 13, 2012).

Matson et al., Computer Calculations of Pressure and Temperature Effects on Length of Tubular Goods During Deep Well Stimulation, Oct. 2-5, 1966, SPE 1559, Society of Petroleum Engineers.

Keller et al., Temperature Distribution in Circulating Mud Columns, 1973, SPE 3605, Society of Petroleum Engineers.

Wu et al., An Analytical Solution for Wellbore Heat Transmission in Layered Formations, 1990, SPE 17497, Society of Petroleum Engineers.

Aasen et al., Buckling Models Revised, Sep. 9-11, 2002, SPE 77245, Society of Petroleum Engineers.

Hagoort, Ramsey's Wellbore Heat Transmission Revised, Dec. 2004, SPE 87305, Society of Petroleum Engineers.

Hasan et al. A Robust Steady-State Model for Flowing-Fluid Temperature in Complex Wells, Nov. 11-14, 2007, SPE 109765, Society of Petroleum Engineers.

* cited by examiner

SYSTEM AND METHOD FOR COMPLETION OPTIMIZATION

CROSS-REFERENCE TO RELATED APPLICATIONS

The present application is a United States National Stage commencement under 35 U.S.C. 371 of prior International Application no. PCT/US2009/066043, filed Nov. 30, 2009, which claims the benefit of the filing date of U.S. Provisional Patent Application No. 61/145,183, filed Jan. 16, 2009. The entire disclosures of these prior applications are incorporated herein by this reference.

FIELD OF THE INVENTION

This invention relates, in general, to completing a wellbore that traverses one or more subterranean hydrocarbon bearing formations and, in particular, to a system and method for completion optimization using a computer implemented system and method to dynamically modeled the service tool string and the downhole environment.

BACKGROUND OF THE INVENTION

Without limiting the scope of the present invention, its background is described with reference to the production of hydrocarbons through a wellbore traversing unconsolidated or loosely consolidated formations, as an example.

It is well known in the subterranean well drilling and completion art that particulate materials such as sand may be produced during the production of hydrocarbons from a well traversing one or more unconsolidated or loosely consolidated subterranean formations. Numerous problems may occur as a result of the production of such particulate. For example, the particulate causes abrasive wear to components within the well, such as tubing, pumps and valves. In addition, the particulate may partially or fully clog the well creating the need for an expensive workover. Also, if the particulate matter is produced to the surface, it must be removed from the hydrocarbon fluids by processing equipment at the surface.

One method for preventing the production of such particulate material to the surface is gravel packing the well adjacent the unconsolidated or loosely consolidated production interval. In a typical gravel pack completion, a completion string including a packer, a circulation valve, a fluid loss control device and one or more sand control screens is lowered into the wellbore to a position proximate the desired production interval. A service tool is then positioned within the completion string and a fluid slurry including a liquid carrier and a particulate material known as gravel is then pumped through the circulation valve into the well annulus formed between the sand control screens and the perforated well casing or open hole production zone.

The liquid carrier either flows into the formation or returns to the surface by flowing through the sand control screens or both. In either case, the gravel is deposited around the sand control screens to form a gravel pack, which is highly permeable to the flow of hydrocarbon fluids but blocks the flow of the particulate carried in the hydrocarbon fluids. As such, gravel packs can successfully prevent the problems associated with the production of particulate materials from the formation. During certain gravel packing operations in well having multiple zones, the service tool used to deliver the gravel slurry may be positioned relative to each of the zones to be completed in a single trip. For example, the service tool is typically first positioned relative to the lowermost zone to perform the first gravel packing operation then lifted uphole to sequentially perform gravel packing operations on the next uphole zone until each of the zones is gravel packed. It has been found, however, that such axially movement of the service tool relative to the completion string lacks precision and certainty regarding the exact location of certain service tool components relative to particular landing points within the completion string. Specifically, the service tool is repositioned by raising and lowering the block at the surface, which is typically thousands of feet away from the downhole landing points of the service tool. The distance the block is moved at the surface, however, does not directly translated to the distance the service tool moves downhole. For example, movement of the service tool is effected by both static and dynamic frictional forces, gravitational forces, pressure forces and the like. This is particularly acute in slanted, deviated and horizontal wells. In addition, the length of the service tool string is not constant due to thermal effects, particularly in deep-water completions.

Therefore, a need has arisen for systems and methods for completing a wellbore that traverses one or more subterranean hydrocarbon bearing formations that enhance the precision and certainty regarding the location of the service tool relative to a particular landing point or landing points within the completion string. A need has also arisen for such systems and methods that are able to correlate between the distance the block is moved at the surface and the distance the service tool moves downhole. Further, need has arisen for such systems and methods that are able to account for the thermal effects experienced by the service tool string in downhole environments including subsea environments.

SUMMARY OF THE INVENTION

The present invention disclosed herein is directed to systems and methods for completing a wellbore that traverses one or more subterranean hydrocarbon bearing formations that enhance the precision and certainty regarding the location of the service tool relative to a particular landing point or landing points within the completion string. The systems and methods of the present invention are able to correlate between the distance the block is moved at the surface and the distance the service tool moves downhole accounting for friction forces, gravitational force, pressure forces and the like. In addition, the systems and methods of the present invention are able to account for the thermal effects experienced by the service tool string in downhole environments including subsea environments.

In one aspect, the present invention is directed to a system for completing a wellbore. The system includes a completion positioned within the wellbore. The completion has at least one landing point defined therein. A service tool is axially movable within the completion. The service tool is coupled to a service tool string extending from the surface and selectively supported by a movable block above the surface. A subsurface model is defined in a computer operably associated with the wellbore. The model is operable to predict the position of the service tool relative to the at least one landing point of the completion based upon a dynamic lumped mass model of the service tool string and a dynamic lumped capacitance thermal model of the wellbore environment.

In one embodiment, the subsurface model includes wellbore design, completion design and service tool design. In another embodiment, the subsurface model is updated with block movement information and hook load information. In one embodiment, the dynamic lumped mass model of the service tool string defines a plurality of axial sections of the service tool string and represents each axial section as a single mass. In this embodiment, a connection between adjacent masses may be represented as a spring and damper. In another embodiment, the dynamic lumped mass model of the service tool string includes frictional forces, gravitational forces and pressure pistoning forces.

In one embodiment, the dynamic lumped capacitance thermal model of the wellbore environment includes a bottom hole temperature and a temperature profile between the bottom hole temperature and a surface temperature. In this embodiment, a linear profile may be applicable in onshore wellbores and for offshore wellbore in the region between the bottom hole and the sea floor with the temperature profile between the sea floor and the rig floor being based upon known temperature profiles for sea water. In another embodiment, the dynamic lumped capacitance thermal model of the wellbore environment includes fluid circulation rate and return fluid temperature. In one embodiment, the dynamic lumped capacitance thermal model of the wellbore environment defines a plurality of axial sections of the wellbore with each axial section being divided into a plurality of annular nodes. In this embodiment, heat transfer between adjacent annular nodes may be represented as resistance.

In one embodiment, the subsurface model includes an auto calibration function that correlates the predicted position of the service tool relative to the at least one landing point of the completion with the actual position of the service tool relative to the at least one landing point of the completion when the service tool sets down in a landing point. In another embodiment, the subsurface model defines a zone of confidence regarding the position of the service tool relative to the at least one landing point of the completion after a predetermined period of time following a predetermined event.

In another aspect, the present invention is directed to a method for completing a wellbore. The method includes positioning a completion within the wellbore, the completion having at least one landing point defined therein, and disposing an axially movable service tool within the completion, the service tool coupled to a service tool string extending from the surface and selectively supported by a movable block above the surface. The method also includes defining a subsurface model in a computer operably associated with the wellbore, the model predicting the position of the service tool relative to the at least one landing point of the completion based upon a dynamic lumped mass model of the service tool string and a dynamic lumped capacitance thermal model of the wellbore environment.

In another aspect, the present invention is directed to a system for completing a wellbore. The system includes a completion positioned within the wellbore. The completion has at least one landing point defined therein. A service tool is axially movable within the completion. The service tool is coupled to a service tool string extending from the surface and selectively supported by a movable block above the surface. A controller is operable to control the movement of the block such that the service tool may be raised and lowered in the wellbore. A subsurface model is defined in a computer operably associated with the controller. The model is operable to predict the position of the service tool relative to the at least one landing point of the completion based upon a dynamic lumped mass model of the service tool string and a dynamic lumped capacitance thermal model of the wellbore environment.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the invention.

Figure 1:
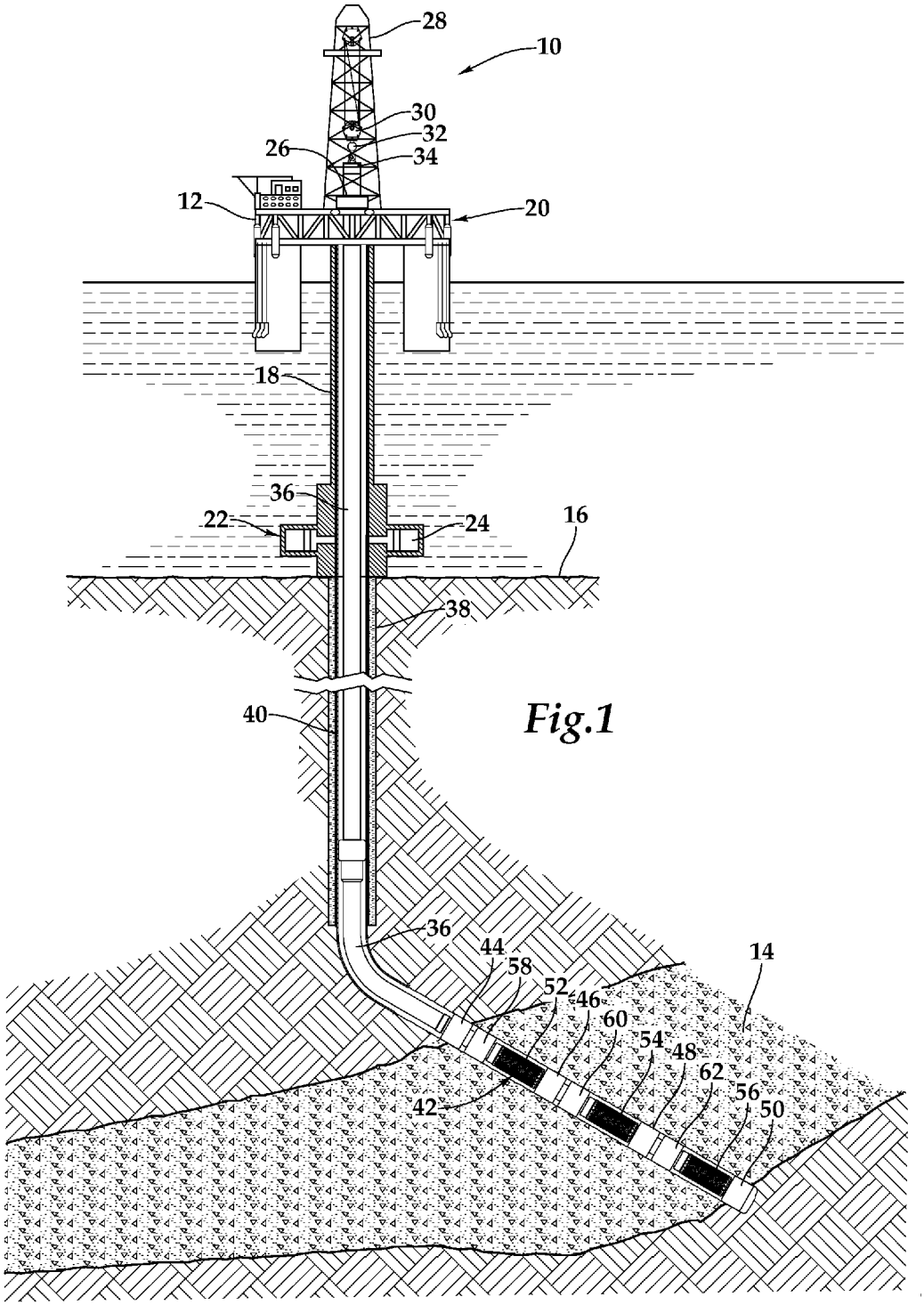
FIG. 1 is a schematic illustration of an offshore oil and gas platform operating a system for completing a wellbore including a computer implemented completion optimization tool according to an embodiment of the present invention.

Referring initially to FIG. 1, a computer implemented completion optimization tool for use in a completion system is deployed from an offshore oil or gas platform is schematically illustrated and generally designated 10. A semi-submersible platform 12 is centered over submerged oil and gas formation 14 located below sea floor 16. A subsea conduit 18 extends from deck 20 of platform 12 to wellhead installation 22, including blowout preventers 24. Platform 12 has a hoisting apparatus 26, a derrick 28, a travel block 30, a hook 32 and a swivel 34 for raising and lowering pipe strings, such as a substantially tubular, longitudinally extending service tool string 36.

A wellbore 38 extends through the various earth strata including formation 14. An upper portion of wellbore includes casing 40 that is cemented within wellbore 38. Disposed in an open hole portion of wellbore 38 is a completion 42 that includes various tools such as packers 44, 46, 48, 50 that provide zonal isolation for the production of hydrocarbons in certain zones of interest within wellbore 38. When set, packers 44, 46, 48, 50 isolate zones of the annulus between wellbore 38 and completion 42. In this manner, formation fluids from formation 14 enter the annulus between wellbore 38 and completion 42 between packers 44, 46, between packers 46, 48, and between packers 48, 50. Additionally, gravel pack and fracpack slurries or other treatment fluids may be pumped into the isolated zones provided therebetween.

Completion 42 also includes sand control screen assemblies 52, 54, 56. As shown, packers 44, 46, 48, 50 are respectively located above and below each of the sand control screen assemblies 52, 54, 56. Completion 42 further includes closing sleeves 58, 60, 62 that provided a pathway through completion 42 for the delivery of a fluid slurry into the annulus surrounding the various isolated portions of completion 42 during a treatment process. Closing sleeves 58, 60, 62 each include one or more interior landing points designed to receive various portions of the service tool carried on the lower end of service tool string 36, which is disposed within completion 42 in FIG. 1. As used herein, the term landing points refers to any location within completion 42 where it may be desirable to locate the service tool. As an example, the service tool includes a cross over assembly that must be sequentially positioned precisely within each of closing sleeves 58, 60, 62 in order to treat each of the zones. This positioning is achieved by raising or lowering travel block 30 which in turn raises and lowers service tool string 36. Unfortunately, the distance travel block 30 is moved is not directly related to the distance the service tool is moved due to a variety of factors including frictional forces, gravitational forces, pressure pistoning forces, thermal forces and the like. In the present invention, however, a subsurface model defined in a computer is operable to predict the position of the service tool relative to the landing points in completion 42 based upon a dynamic lumped mass model of the service tool string and a dynamic lumped capacitance thermal model of the wellbore environment.

Even though FIG. 1 depicts a slanted wellbore, it should be understood by those skilled in the art that the system of completing a wellbore according to the present invention is equally well suited for use in wellbore having other orientations including vertical wellbores, horizontal wellbores, multilateral wellbores or the like. Accordingly, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Also, even though FIG. 1 depicts an offshore operation, it should be understood by those skilled in the art that the system of completing a wellbore according to the present invention is equally well suited for use in onshore operations.

Figure 2:
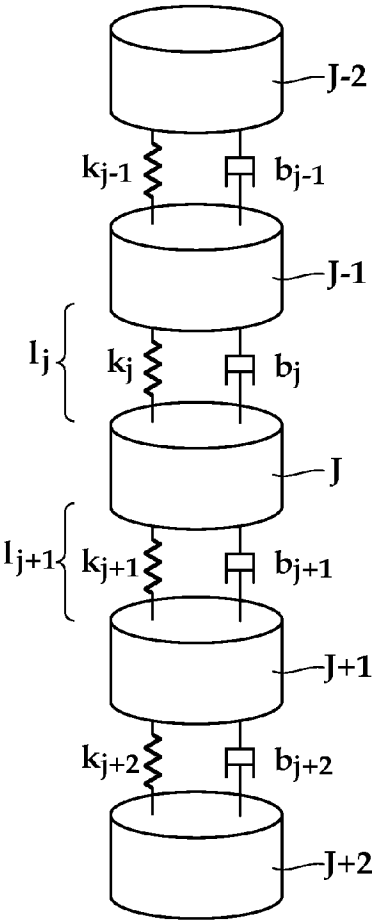
FIG. 2 is representation of a dynamic lumped mass model of a service tool string used in the computer implemented completion optimization tool of the completion system according to an embodiment of the present invention.

Referring next to FIG. 2, therein is depicted one embodiment of a dynamic lumped mass model of a service tool string used in the computer implemented completion optimization tool of the completion system according to the present invention. To accurately model the position and motion of the service tool within the completion, referred to herein as a subsurface model, the dynamic motion due to block movement as well as length changes of the service tool string due to factors such as frictional forces, gravitational forces, pressure pistoning forces, thermal forces and the like must be considered.

To model these forces, the service tool string, from the travel hook to the completion, is split into a plurality of sections with the mass of each section assumed to be at the midpoint of that section, which is referred to herein as a lumped mass model. Each of the masses is then assumed to be coupled to each adjacent mass by a spring and damper. As depicted in FIG. 2, five such sections or masses are shown, each coupled to the adjacent masses with a spring and damper. It should be understood by those skilled in the art that the five mass illustration of FIG. 2 is representative of a short section of the service tool string. The actual number of masses will typically be in the hundreds or thousands depending upon the length of the service tool string, the desired precision of the model and the computational power available. This lumped mass model is operable to account for transitional inertial forces, static and dynamic frictional forces, axial spring forces and dampening forces.

In constructing the lumped mass model of the service tool string, an equation is created for each mass, such as mass j, which can be expressed as an equation of motion as follows:

$$m\ddot{x}=-b_j(\dot{x}_j-\dot{x}_{j-1})+b_{j+1}(\dot{x}_{j+1}-\dot{x}_j)-k_j(x_j-x_{j-1})+k_{j+1}(x_{j+1}-x_j)-F_f-F_g-F_p-k_j\alpha(\Delta T_j)l_j+k_{j+1}\alpha(\Delta T_{j+1})l_{j+1}$$

Where, b is the axial damping coefficient of the pipe, k is the spring coefficient of the pipe, $F_f$ is the frictional force, $F_g$ is the gravitational force, $F_p$ is the pressure pistoning force, $\alpha$ is the thermal expansion coefficient, $\Delta T$ is the change in temperature and l is the length of the pipe section. Once the equation of motion is created for each mass, the equations can be converted to a first order state space representation by letting $y_1=x$ and $y_2=\dot{x}$. The equations can then be represented as first order differential equations in the form $\dot{y}_i=Ay_i+Bu$ and solved as a matrix with the force on the uppermost mass in the model being the hook load. In one implementation of the lumped mass model, the dynamic A matrix and input B matrix are discritized to get difference equations through an approximation as follows:

$$A_D=[I+At+(A^2t^2)/2!+(A^3t^3)/3!+(A^4t^4)/4!+\ldots]$$

$$B_D=[It+(At^2)/2!+(A^2t^3)/3!+(A^3t^4)/4!+\ldots]B$$

For certain implementations, such as models with the masses 100 meters apart, the time sample may be t=0.01 seconds and the approximation may be truncated at the 4th power of t. The position and velocity of each mass can then be calculated recursively at every time step k+1 from the time step k data from the following equation:

$$X_{k+1}=A_DX_k+B_DU_k$$

Figure 3A:
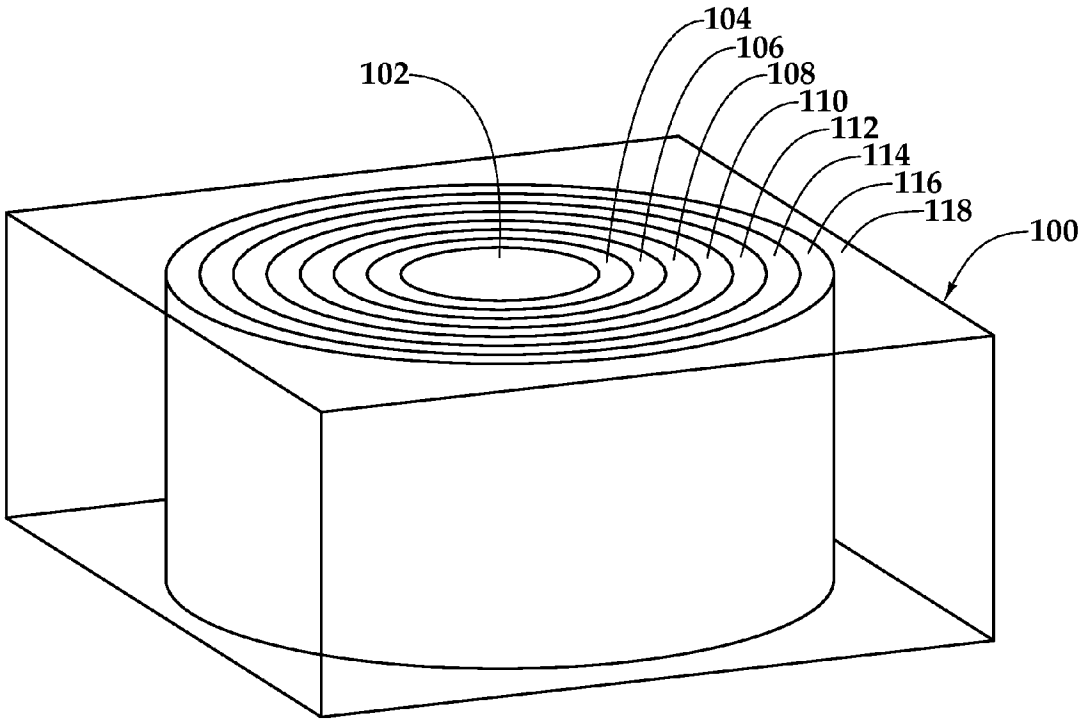
FIG. 3A-3B depict aspects of a dynamic lumped capacitance thermal model of the wellbore environment including a resistance representation used in the computer implemented completion optimization tool of the completion system according to an embodiment of the present invention.
Figure 3B:
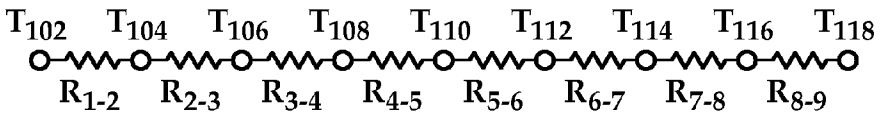

Referring next to FIGS. 3A-3B, therein is depicted one embodiment of a dynamic lumped capacitance thermal model of the wellbore environment used in the computer implemented completion optimization tool of the completion system according to the present invention. The dynamic lumped capacitance thermal model is used to determine $\Delta T_i$ for input into the equations above. More generally, the thermal model is used to determine temperature changes along the service tool string due to pumping of the treatment slurry down the service tool string and circulating the return fluids up the annulus as well as residual thermal effects. As the service tool string will reach a thermal equilibrium with the surrounding formation after being in place for a given period of time, most of the thermal changes of concern are in response to pumping and circulating fluids through the system as the fluids have a different temperature than the surrounding formation. Following the pumping process, residual effects or transient thermal effects occur as the service tool string returns to the ambient temperature of the well.

Similar to the dynamic lumped mass model, in the dynamic lumped capacitance thermal model the wellbore is split into a plurality of axial sections such as that depicted in FIG. 3A and generally designated 100. The axial sections are then split into annular sections including the fluid within the tubing at 102, the tubing 104, the fluid within the annulus at 106, the casing 108 (in a cased well), the cement 110 (in a cased well), and then a series of rock layers such as rock layer 112, rock layer 114, rock layer 116 and rock layer 118. The number of rock layers may be selected based upon factors such as the type of rock in the formation and its thermal coefficients, the desired precision of the model and the computational power available. The outermost rock layer, in this case rock layer 118, is considered to be an ambient boundary with constant temperature.

In one implementation of the lumped capacitance model, once the wellbore environment is divided into sections, the sections are coupled together through the input and output of the fluid flow therethrough. In this approach, each section that is lumped together is assumed to have a constant temperature and between each section a resistance to heat transfer is modeled to represent the boundaries between the lumped capacitances, as best seen in FIG. 3B. The model includes equations of the energy balance for each node in the form of [rate of energy storage in the node]=[rate of energy gain from flow in−flow out]+[rate of energy gain from convection at flowing boundaries]+[rate of energy gain from conduction with adjacent nodes]. The temperatures are assumed to be at the center of the component, therefore heat conducted through half of the material of the component to reach the center must be taken into account. The model may be represented as an electrical circuit using the assumption that the capacitance of the ith layer is $C_i=\rho_i c_i V_i$, where, $\rho_i$ is the density of the layer, $c_i$ is the specific heat and $V_i$ is the volume within the layer. In addition, the resistance of the ith layer is inversely proportional to the heat transfer within the node. As the governing equations of the thermal model are nonlinear due to changing parameters with velocity and temperature, it is assumed that the parameters only change every step. The application of a zero order hold between the time steps allows for the construction of a step varying state space model with the nonlinear behavior captured by recalculating the thermal model every time step. The state space model of each axial section of the wellbore environment is then put in a matrix to determine $\Delta T_i$ for input into the equations above for the lumped mass model. In one embodiment, each section in the lumped mass model is broken into two sections in the lumped capacitance thermal model.

In operation, the system is designed to auto build the model for the particular well and is run in real-time, preferably starting when the service tool is close to a known location within the completion. Information such as well path including depth, azimuth and inclination, sea depth in offshore applications, tubing sizes, service tool geometry of each part including diameters and lengths, completion information for landing point locations, bottom hole temperature, surface temperature (rig floor and sea floor in offshore applications), properties of the fluid or fluids to be pumped or circulated, estimated frictional coefficients and the like are provided to the system. Once the system has this information, it builds the discrete model of the service tool string dynamics. The thermal model is also auto built and is rebuilt every time it is run to account for nonlinear changes of the model. In one implementation, the lumped mass model is run every 0.01 seconds with the lumped capacitance thermal model rebuilt and run every 50 iterations with the temperature changes included in the lumped mass model to calculate the thermal forces.

Figure 4:
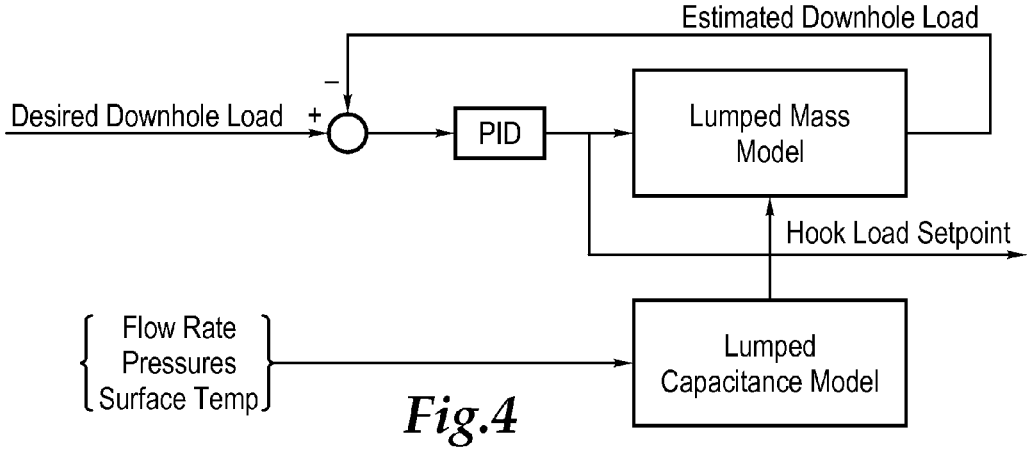
FIG. 4 is a process diagram of one implementation of the computer implemented completion optimization tool of the completion system according to an embodiment of the present invention.

Once the subsurface model has been built, it may be used to optimize and reduce the risk associated with numerous completion operations and variables. In one implementation depicted in FIG. 4, the hook load required to maintain a specific contact force downhole during a pumping operation is determined. As illustrated and described above, various inputs are fed into the lumped capacitance model including flow rate of the pumped or circulated fluid, pressures, surface temperature and the like. The results of the lumped capacitance model are fed into the lumped mass model. With this information, a control input, depicted as a PID controller is fed with the desired downhole load and the predicted downhole load which is used to determine the minimum required hook load to maintain the desired downhole load. This information may be provided to a well operator in a visual representation of the subsurface environment and recommendations regarding adjustments to the hook position and velocity to maintain the desired contact force downhole. Alternatively, the system may be part of a closed loop completion control system as describe below wherein the output of the system includes information directed to a controller that operates the position and velocity of the hook.

Figure 5:
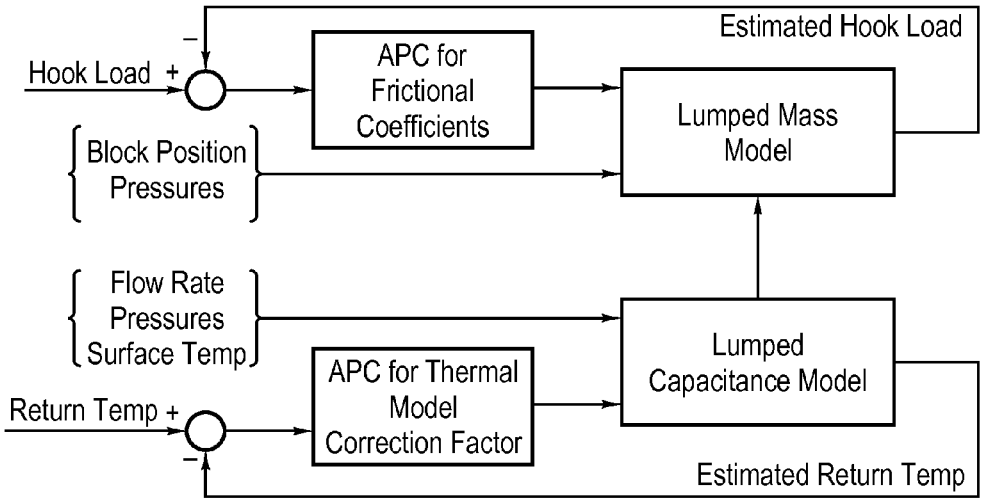
FIG. 5 is a process diagram of one implementation of the computer implemented completion optimization tool of the completion system according to an embodiment of the present invention.

In another implementation of the subsurface model as depicted in FIG. 5, the static and dynamic coefficients of friction and a thermal model correction factor during pumping may be determined. As illustrated and described above, various inputs are fed into the lumped capacitance model including flow rate of the pumped or circulated fluid, pressures, surface temperature and the like. The results of the lumped capacitance model are fed into the lumped mass model along with information relating to block position, pressures and the like. With this information, the hook load and estimated hook load are fed into an adaptive parametric controller, which may be use error driven controller such as an integrator controller, a neural network controller, a fuzzy logic controller, a comparison to reference values or the like to determine the actual static and dynamic coefficients of friction throughout the system. One use of this implementation is during the cleanup process following a treatment operation wherein the state of the clean up could be determined based on the frictional effects. For example, during the clean up phase, the frictional effects will decrease to a nominal amount from the normal operating condition parametric adaption to indicate the cleanup has been successfully completed. Likewise, the return fluid temperature and estimated return fluid temperature are fed into an adaptive parametric controller, which may be use error driven controller such as an integrator controller, a neural network controller, a fuzzy logic controller, a comparison to reference values or the like to determine the thermal model correction factors throughout the system. This type of auto-model fitting improves the results of the model to better fit current operating conditions.

Figure 6:
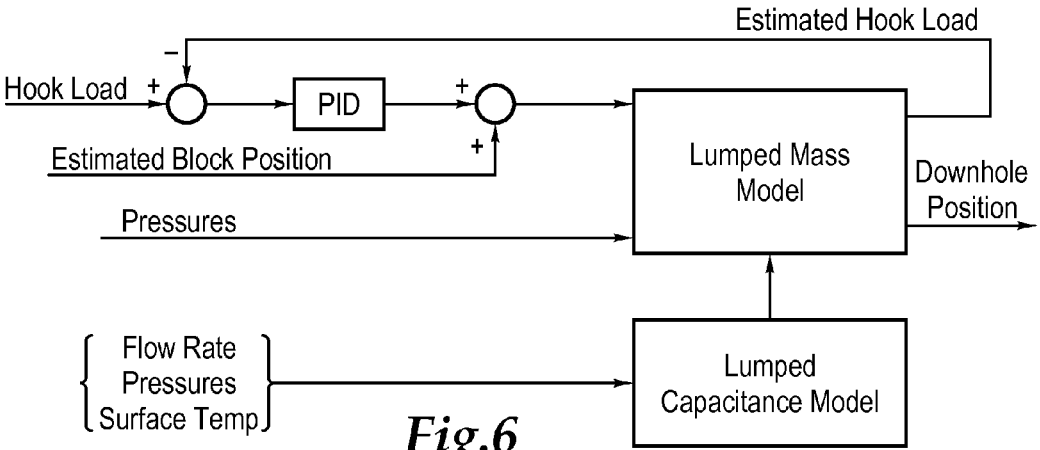
FIG. 6 is a process diagram of one implementation of the computer implemented completion optimization tool of the completion system according to an embodiment of the present invention.

In a further implementation of the subsurface model as depicted in FIG. 6, landing point calibration of the system is achieved using known landing points. As illustrated and described above, various inputs are feed into the lumped capacitance model including flow rate of the pumped or circulated fluid, pressures, surface temperature and the like. The results of the lumped capacitance model as well as information such as pressures are fed into the lumped mass model. With this information, a control input, depicted as a PID controller, is fed with hook load and estimated hook load information which is combined with estimated block position information to determine new block position. This information is fed back into the lumped mass model to determine an estimated downhole position. This process continues until the estimated downhole position and the actual downhole position match. This information may be provided to a well operator in a visual representation of the subsurface environment. In addition, this implementation may provide the operator with information indicating the position of the service tool in the completion including whether the service tool is in the vicinity of a landing point in the completion and whether the service tool has located in a landing point in the completion. In certain cases, this information can be used to inform the operator of a recommended course of action regarding adjustments to the hook position and velocity or may be part of a closed loop completion control system as described below wherein the output of the system includes information directed to a controller that operates the position and velocity of the hook.

Figure 7:
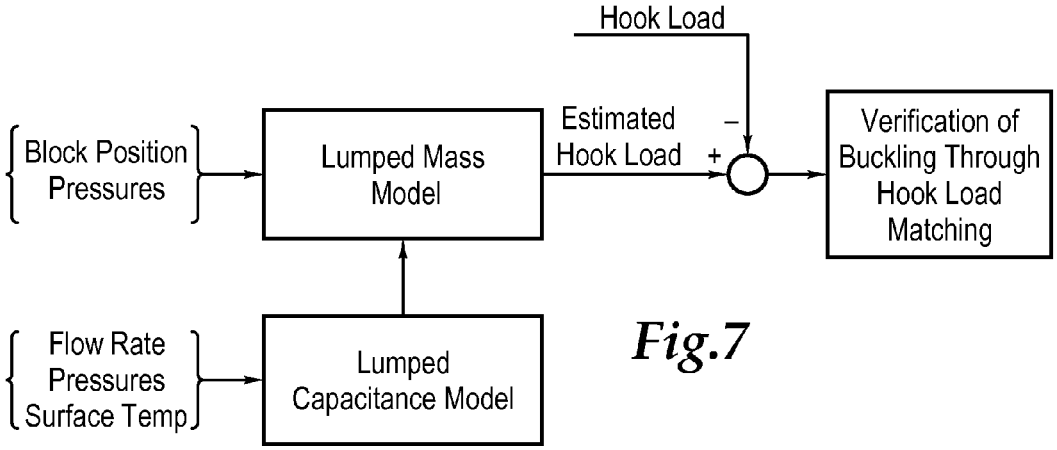
FIG. 7 is a process diagram of one implementation of the computer implemented completion optimization tool of the completion system according to an embodiment of the present invention.

In yet another implementation of the subsurface model as depicted in FIG. 7, detection of buckling and buckling location may be determine. As illustrated and described above, various inputs are feed into the lumped capacitance model including flow rate of the pumped or circulated fluid, pressures, surface temperature and the like. The results of the lumped capacitance model as well as information such as pressures and block position are fed into the lumped mass model. With this information, the actual hook load and estimated hook load are compared to provide predicted buckling information and verification buckling information. The information can be provided to the operator as a visual representation and be used to inform the operator of a downhole condition that is reaching the buckling threshold of the service tool string as well as confirm the presence of buckling. The model is operable to predict where the buckling has occurred and the current state of the service tool string.

Figure 8:
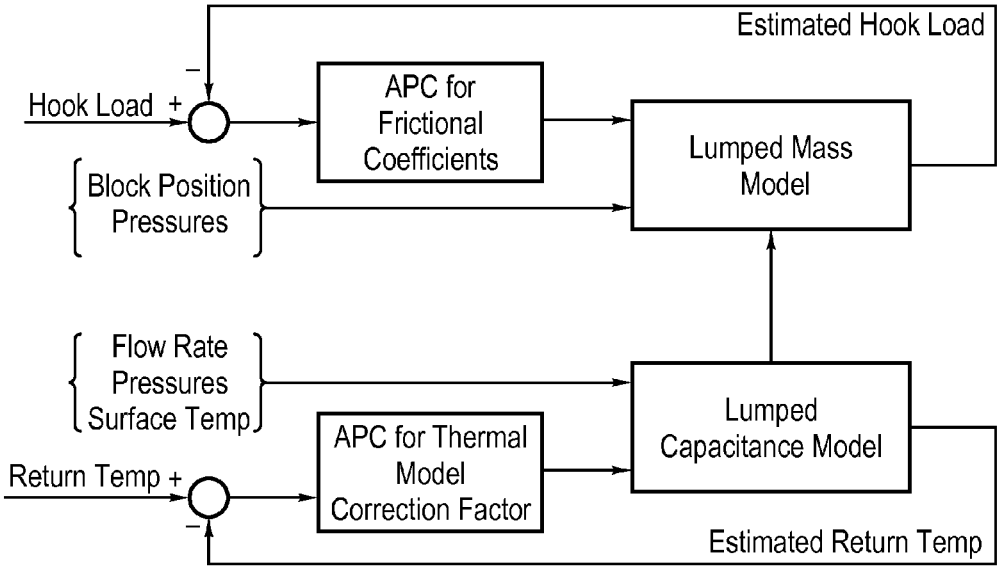
FIG. 8 is a process diagram of one implementation of the computer implemented completion optimization tool of the completion system according to an embodiment of the present invention.

An additional implementation of the subsurface model is depicted in FIG. 8, wherein a zone of confidence regarding the position of the service tool relative to a landing point in the completion may be determine. As illustrated and described above, various inputs are fed into the lumped capacitance model including flow rate of the pumped or circulated fluid, pressures, surface temperature and the like. The results of the lumped capacitance model are fed into the lumped mass model along with information relating to block position, pressures and the like. With this information, the hook load and estimated hook load are fed into an adaptive parametric controller, which may be use error driven controller such as an integrator controller, a neural network controller, a fuzzy logic controller, a comparison to reference values or the like to determine the actual static and dynamic coefficients of friction throughout the system. Likewise, the return fluid temperature and estimated return fluid temperature are fed into an adaptive parametric controller, which may be use error driven controller such as an integrator controller, a neural network controller, a fuzzy logic controller, a comparison to reference values or the like to determine the thermal model correction factors throughout the system.

Using the rate of change of adaptation of the model, the estimated error associated with the parameters of the model are determined, thereby providing a confidence level for the model. For example, following a treatment operation in a first zone, the service tool is reposition in a second zone. Due to the length of time for repositioning the service tool and the length of time between treatment operations, residual thermal effects may cause the service tool string to change in length. The present subsurface model will predict the length change but also predict the potential error in this calculation. In certain critical operations, this zone of confidence determination may indicate that service tool should be moved to a known landing point which will auto calibrate the system and provide improved confidence as to the position of the service tool relative the desired landing point.

Using the adaptive parametric controller associated with the lumped mass model, factors such as unloaded block movement are filtered out of the calculations. For example, if the hook load goes to an unloaded condition, indicating that the service tool string is being supported by the slips, and the block is relocated due to adding or removing a stand of pipe, the service tool position does not change. Accordingly, the system accounts for the various inputs, block movement with no hook load, to determine the no change in the service tool location should be included in the estimated service tool position.

Figure 9:
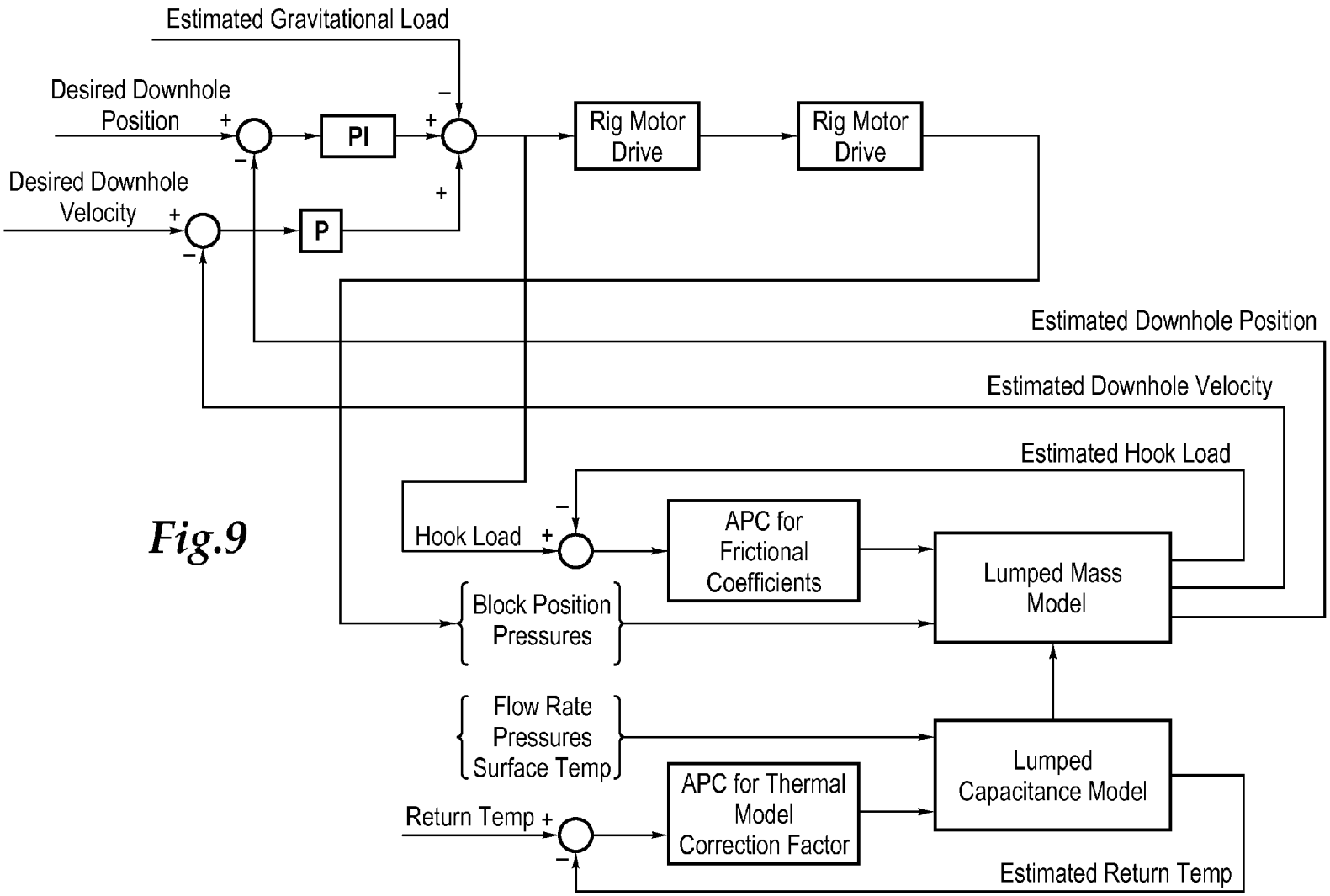
FIG. 9 is a process diagram of one implementation of the computer implemented completion optimization tool of the completion system according to an embodiment of the present invention.

As mentioned above, the subsurface model of the present invention may be coupled to a control system for operating the hook position and velocity as depicted in FIG. 9. As illustrated and described above, various inputs are fed into the lumped capacitance model including flow rate of the pumped or circulated fluid, pressures, surface temperature and the like as well as feedback from an adaptive parametric controller having inputs of return fluid temperature and estimated return fluid temperature. The results of the lumped capacitance model are fed into the lumped mass model along with information relating to block position, pressures and the like as well as feedback from an adaptive parametric controller having inputs of hook load and estimated hook load. The determined estimated downhole velocity and estimated downhole position from the subsurface model are fed to respective controllers and combined with the desired downhole velocity and desired downhole position information. The controllers use this information along with estimated gravitational information to send command to the rig motor drive which provides motion to the hook.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A system for completing a wellbore, the system comprising: at least one computer processor a completion positioned within the wellbore, the completion having at least one landing point defined therein;

a service tool axially movable within the completion, the service tool coupled to a service tool string extending from the surface and selectively supported by a movable block above the surface; and a subsurface model defined using the computer processor operably associated with the wellbore, the model configured to predict the position of the service tool relative to the at least one landing point of the completion based upon a dynamic lumped mass model of the service tool string and a dynamic lumped capacitance thermal model of the wellbore environment, wherein the dynamic lumped mass model of the service tool string further comprises defining a plurality of axial sections of the service tool string and representing each axial section as a single mass.

2. The system as recited in claim 1 wherein the subsurface model further comprises wellbore design, completion design and service tool design.

3. The system as recited in claim 1 wherein the subsurface model is updated with block movement information and hook load information.

4. The system as recited in claim 1 wherein the dynamic lumped mass model of the service tool string further comprises representing a connection between adjacent masses as a spring and damper.

5. The system as recited in claim 1 wherein the dynamic lumped mass model of the service tool string further comprises frictional forces, gravitational forces and pressure pistoning forces.

6. The system as recited in claim 1 wherein the dynamic lumped capacitance thermal model of the wellbore environment further comprises a bottom hole temperature and a temperature profile between the bottom hole temperature and a surface temperature.

7. The system as recited in claim 1 wherein the dynamic lumped capacitance thermal model of the wellbore environment further comprises fluid circulation rate and return fluid temperature.

8. The system as recited in claim 1 wherein the dynamic lumped capacitance thermal model of the wellbore environment further comprises defining a plurality of axial sections of the wellbore, each axial section including a plurality of annular nodes.

9. The system as recited in claim 8 wherein the dynamic lumped capacitance thermal model of the wellbore environment further comprises representing heat transfer between adjacent annular nodes as resistance.

10. The system as recited in claim 1 wherein the subsurface model further comprises an auto calibration function that correlates the predicted position of the service tool relative to the at least one landing point of the completion with the actual position of the service tool relative to the at least one landing point of the completion when the service tool sets down in a landing point of the completion.

11. The system as recited in claim 1 wherein the subsurface model defines a zone of confidence regarding the position of the service tool relative to the at least one landing point of the completion after a predetermined period of time following a predetermined event.

12. A method for completing a wellbore, the method comprising:

positioning a completion within the wellbore, the completion having at least one landing point defined therein;

disposing an axially movable service tool within the completion, the service tool coupled to a service tool string extending from the surface and selectively supported by a movable block above the surface; and defining a subsurface model in a computer operably associated with the wellbore, the model predicting the position of the service tool relative to the at least one landing point of the completion based upon a dynamic lumped mass model of the service tool string and a dynamic lumped capacitance thermal model of the wellbore environment, wherein the dynamic lumped mass model of the service tool string further comprises defining a plurality of axial sections of the service tool string and representing each axial section as a single mass.

13. The method as recited in claim 12 wherein defining a subsurface model in a computer further comprises including wellbore design, completion design and service tool design in the subsurface model.

14. The method as recited in claim 12 wherein defining a subsurface model in a computer further comprises updating the subsurface model with block movement information and hook load information.

15. The method as recited in claim 12 wherein defining a subsurface model in a computer further comprises representing a connection between adjacent masses as a spring and damper.

16. The method as recited in claim 12 wherein defining a subsurface model in a computer further comprises including frictional forces, gravitational forces and pressure pistoning forces in the dynamic lumped mass model of the service tool string.

17. The method as recited in claim 12 wherein defining a subsurface model in a computer further comprises including a bottom hole temperature and a temperature profile between the bottom hole temperature and a surface temperature in the dynamic lumped capacitance thermal model of the wellbore environment.

18. The method as recited in claim 12 wherein defining a subsurface model in a computer further comprises including fluid circulation rate and return fluid temperature in the dynamic lumped capacitance thermal model of the wellbore environment.

19. The method as recited in claim 12 wherein defining a subsurface model in a computer further comprises defining a plurality of axial sections of the wellbore and defining a plurality of annular nodes in each axial section of the wellbore in the dynamic lumped capacitance thermal model of the wellbore environment.

20. The method as recited in claim 19 wherein defining a subsurface model in a computer further comprises representing heat transfer between adjacent annular nodes as resistance.

21. The method as recited in claim 12 wherein defining a subsurface model in a computer further comprises auto calibrating the subsurface model to correlate the predicted position of the service tool relative to the at least one landing point of the completion with the actual position of the service tool relative to the at least one landing point of the completion when the service tool sets down in a landing point.

22. The method as recited in claim 12 further comprising defining a zone of confidence with the subsurface model regarding the position of the service tool relative to the at least one landing point of the completion after a predetermined period of time following a predetermined event.

23. A system for completing a wellbore, the system comprising: at least one computer processor a completion positioned within the wellbore, the completion having at least one landing point defined therein;

a service tool axially movable within the completion, the service tool coupled to a service tool string extending from the surface and selectively supported by a movable block above the surface;

a controller operable to control the movement of the block; and a subsurface model defined using the computer processor operably associated with the controller, the model configured to predict the position of the service tool relative to the at least one landing point of the completion based upon a dynamic lumped mass model of the service tool string and a dynamic lumped capacitance thermal model of the wellbore environment, wherein the dynamic lumped mass model of the service tool string further comprises defining a plurality of axial sections of the service tool string and representing each axial section as a single mass.

* * * * *